US006041865A

United States Patent [19]

Knapp

[11] Patent Number: 6,041,865

[45] Date of Patent: Mar. 28, 2000

[54] METHOD AND APPARATUS FOR MOVING A DIVERTER

[75] Inventor: Martin R. Knapp, Houston, Tex.

[73] Assignee: Exmar Offshore Company, Houston, Tex.

[21] Appl. No.: 08/962,109

[22] Filed: Oct. 31, 1997

[51] Int. Cl.[7] ..... E21B 33/035

[52] U.S. Cl. ..... 166/345; 166/351; 166/367

[58] Field of Search ..... 166/363, 367, 166/316, 319, 341, 345, 351

[56] References Cited

U.S. PATENT DOCUMENTS

| | | | |
|---|---|---|---|
| 4,326,584 | 4/1982 | Watkins | 166/82 |
| 4,444,401 | 4/1984 | Roche et al. | 166/363 X |
| 4,478,287 | 10/1984 | Hynes et al. | 166/341 |
| 4,502,534 | 3/1985 | Roche et al. | 166/84 |
| 4,597,447 | 7/1986 | Roche et al. | 166/347 |
| 4,630,680 | 12/1986 | Elkins | 166/368 X |
| 4,712,620 | 12/1987 | Lim et al. | 166/355 |
| 4,828,024 | 5/1989 | Roche | 166/84 |
| 4,832,126 | 5/1989 | Roche | 166/358 |
| 4,971,148 | 11/1990 | Roche et al. | 166/88 |
| 5,560,435 | 10/1996 | Sharp | 166/366 X |

OTHER PUBLICATIONS

International Search Report, 7 pages.

*Primary Examiner*—Frank Tsay
*Attorney, Agent, or Firm*—Rosenthal & Osha L.L.P.

[57] ABSTRACT

A movable diverter housing including a guide adapted to be mounted to the underside of a drill floor on a drilling rig and a diverter housing adapted to move in engagement with the guide.

21 Claims, 6 Drawing Sheets

METHOD AND APPARATUS FOR MOVING A DIVERTER

BACKGROUND OF THE INVENTION

This invention relates to flow diverters used in offshore drilling operations and more particularly to movable diverters.

In offshore oilfield drilling operations, a blowout preventer stack 10 is anchored on the ocean floor 12 at a location where the drilling is to occur, as shown in FIG. 1. A floating drilling platform (e.g., a drill ship or semi-submersible platform) 14, which has a rig floor 16, as shown in FIG. 2, from which drilling operations are accomplished, is positioned on the ocean surface 18 above the blowout preventer stack 10. A flow conduit or riser 20, comprising a string of connected joints of pipe, is built between the drilling platform 14 on the surface 18 and the blowout preventer 10 on the ocean floor 12. The riser 20 is built beginning with a single joint of pipe extending through a well center 22, which is an open passage or hole in the rig floor. As each successive joint of pipe is added to the riser 20, the previous joint is passed through the well center 22, extending the riser 20 toward the ocean floor 12. The riser 20 is connected to the blowout preventer stack 10 with a flex joint 24, which allows the riser 20 to change its angular orientation or flex with respect to the blowout preventer stack 10 without causing damage.

Once installation of the riser 20 is completed and drilling operations begin, the riser 20 provides a fluid passageway between the well 26 and the drilling platform 14. For example, the riser 20 may be used to circulate drilling mud between the well 26 and the drilling platform 14. If a gas pocket is encountered during drilling, the gas may enter the well 26 and travel through the riser 20 to the drilling platform 14, where it can be dangerous to people manning the drilling platform 14 and the equipment they use.

To eliminate this danger, a diverter, comprising a diverter housing 28*a* and a diverter cartridge or insert assembly 28*b* (shown disassembled in FIG. 2), is connected between the riser 20 and the underside of the rig floor 16. When the diverter insert assembly is installed in the diverter housing, the diverter functions as a multi-position valve which, in one position, allows communication between the riser 20 and the well fluid recovery system on the rig (not shown). In the diverter's other positions, the riser 20 may communicate with one or more exhaust passages 30 (only one is shown) which carry dangerous gas away from the drilling platform 14 and out into the atmosphere where it can disperse harmlessly.

Typically, the diverter is fixed to the underside of the rig floor 16, directly beneath the well center 22. The diverter insert assembly 28*b* can be removed from the diverter housing 28*a*, as shown in FIG. 2, and stored outside the rig floor area in the casing rack area 32, but the diverter housing 28*a* is fixedly attached to the underside of the rig floor 16. Consequently, the riser 20 must slide through the diverter housing 28*a*, which is only slightly larger in diameter than the riser 20, as the riser 20 is being constructed. The presence of the diverter housing 28*a* restricts skewing and translation of the riser 20 relative to the rig floor 16 as the riser 20 is being built, which can be a significant problem when seas are rough and the drilling platform 14 is rolling in the seas or where there is a current. When the riser 20 is complete, it is connected to the bottom of the diverter housing via the diverter insert assembly 28*b* (which includes a flex joint not shown in FIG. 1).

SUMMARY OF THE INVENTION

In general, in one aspect, the invention features a movable diverter including a diverter insert assembly, a diverter housing configured to house the diverter insert assembly, the diverter housing engaged with a guide adapted for attachment to an underside of a rig floor, and the diverter housing configured to be moveable in engagement with the guide between a first position below a well center and a second position displaced from the well center.

Implementations of the invention may include one or more of the following. The guide may include a rail. The guide may include two parallel rails. The diverter housing may engage the guide with rollers. The guide may include rails and the diverter housing may engage the guide with shoulders adapted to slide along the rails. The guide may include a pivot.

In general, in another aspect, the invention features a drilling vessel including a rig floor, a guide attached to an underside of the rig floor and a diverter housing configured to be moveable in engagement with the guide between a first position and a second position.

In general, in another aspect, the invention features a movable diverter housing including a guide adapted to be mounted to the underside of a drill floor on a drilling rig and a diverter housing adapted to move in engagement with the guide.

In general, in another aspect, the invention features a method for engaging a diverter in an offshore vessel including storing the diverter housing at a diverter housing storage position while a riser is being run through a well center of the drilling rig, moving the diverter housing in engagement with a guide from the diverter storage position to near the riser running area by engaging it with an actuator, coupling the riser to a diverter insert assembly and inserting the diverter insert assembly into the diverter housing.

In general, in another aspect, the invention features a drilling vessel including a rig floor, the rig floor having an area in the vicinity of the rig floor, a diverter insert assembly and the drilling vessel being adapted to allow the diverter insert assembly to be stored in a storage position in the rig floor area.

Implementations of the invention may include one or more of the following. The storage position may be located beneath a hole in the rig floor. The storage position may include a bracket configured to receive the diverter insert assembly.

DESCRIPTION OF THE PREFERRED EMBODIMENTS

The invention eliminates the interference caused by the diverter housing 28*a* as the riser 20 is being built and run through the well center 22 by adapting the diverter housing 28*a* to be movable away from the well center 22. Once the riser 20 is built, the invention makes it possible to move the diverter housing 28*a* into position on the well center 22 without lifting equipment, thereby reducing the required time and safety risks associated with riser construction and diverter housing installation.

Figure 1:
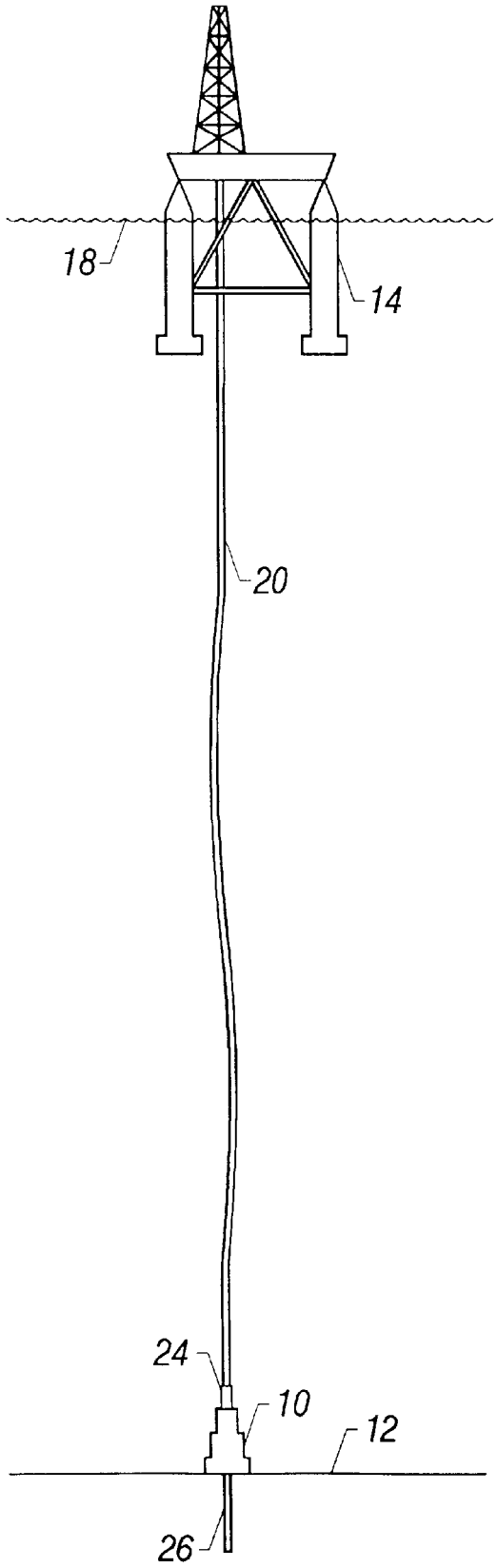
FIG. 1 is a perspective view of an offshore drilling operation.
Figure 2B:
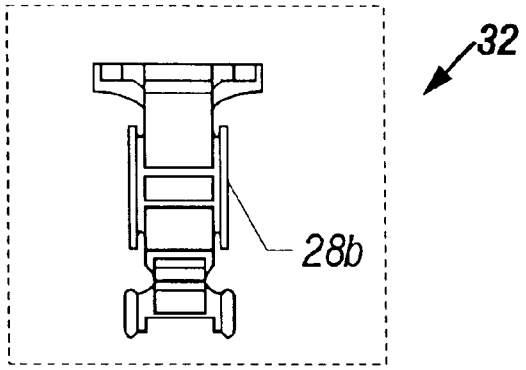
FIG. 2 is a side elevation view of a detail of the rig floor.
Figure 2A:
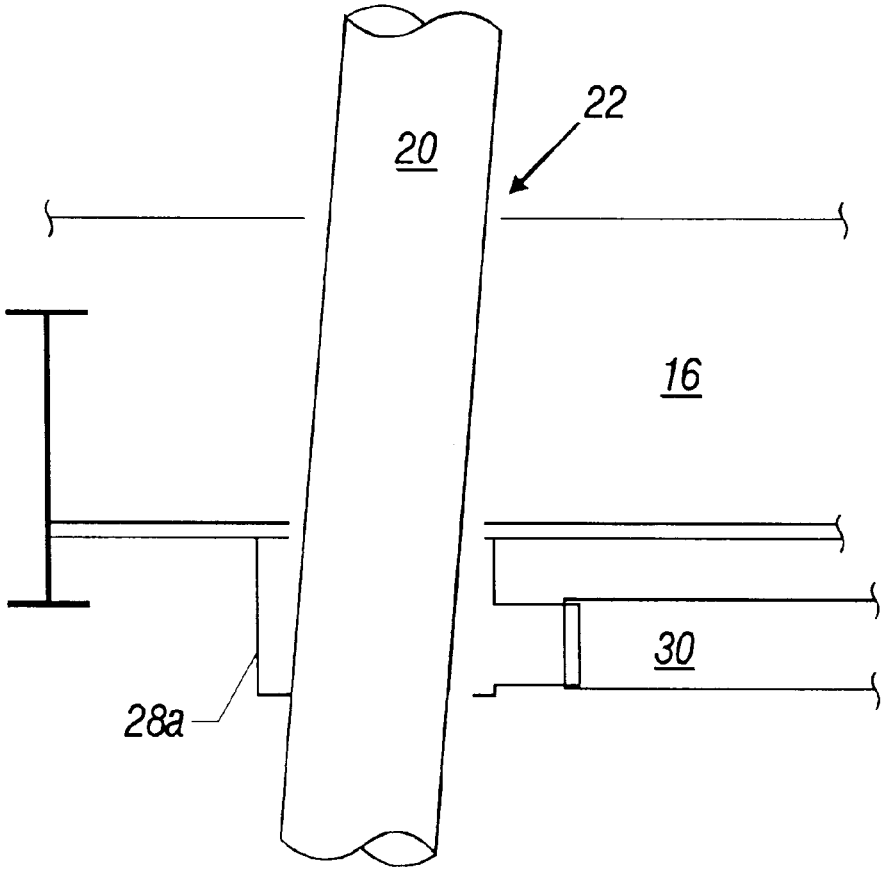
Figure 3:
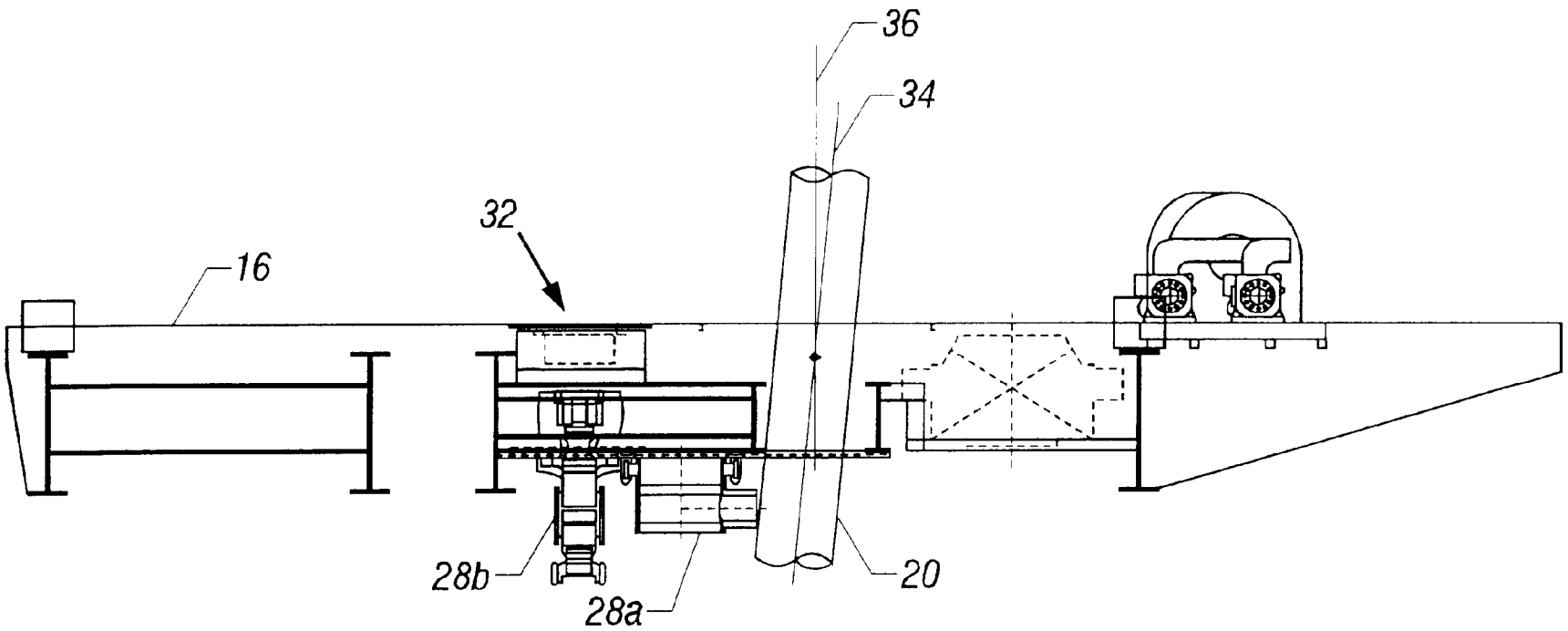
FIG. 3 is a side elevation view of a detail of the rig floor.

During the time that the riser is being built, the diverter housing 28*a* is kept in a storage position, as shown in FIG. 3. The diverter insert assembly 28*a* may be stored in the rig floor area near the well center, for example, beneath the rotary table storage area 32. Because the riser 20 no longer needs to pass through the diverter housing 28*a* as it is being built, the center line of the riser 34 may deviate significantly from the well center line 36 (which coincides with the well center 22), which reduces the danger of damage to the riser 20 or the diverter housing 28*a* during the building of the riser and saves time in construction or removal of the riser.

Figure 4:
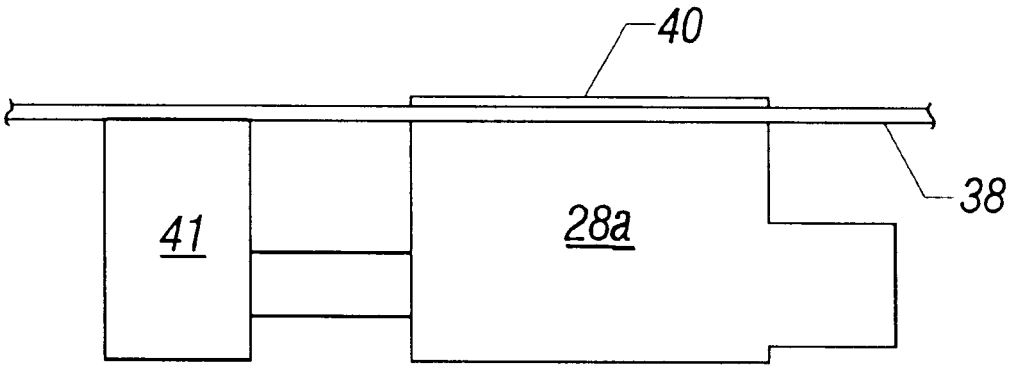
FIG. 4 is a side elevation view of a diverter housing and actuator.
Figure 5:
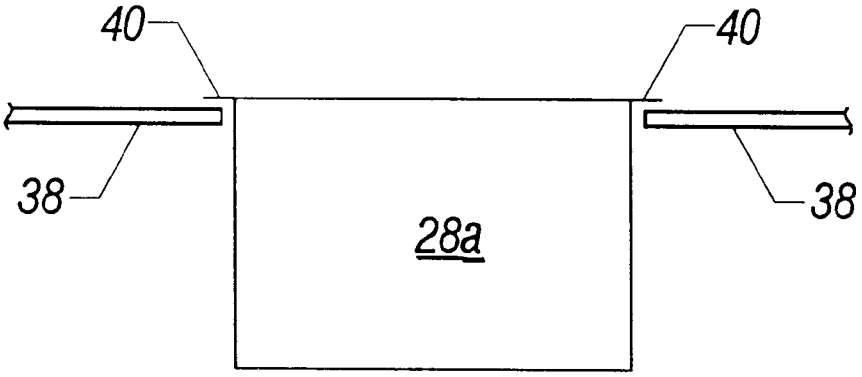
FIG. 5 is a rear elevation view of a diverter housing.

When the riser 20 is complete and secured to the blowout preventer 10 on the sea floor, it becomes necessary to connect the riser 20 to the diverter. The diverter housing 28*a* is first moved into position under the well center 22. To facilitate this, the diverter housing is mounted on rails 38, as shown in FIGS. 4 and 5. The rails 38 are preferably parallel. The diverter housing has shoulders 40 which extend laterally from the top of the diverter housing. These shoulders 40 ride on rails 38, allowing the diverter housing to be moved along the rails 38. The rails 38 are extended beneath the rig floor 16 and on either side of the well center 22. By moving the diverter housing 28*a* along the rails 38, the diverter housing 28*a* can be centered beneath the well center 22.

The motive force for moving the diverter housing is provided by an actuator 41. The actuator can be a hydraulic cylinder, a rack and pinion gear drive, an electrical screw drive or any other mechanism capable of exerting a motive force on the diverter housing. Further, the force may be provided by workers though the use of ropes or chains and pulleys, a come-along or a wench. The force can be a pushing force or a pulling force.

Figure 6:
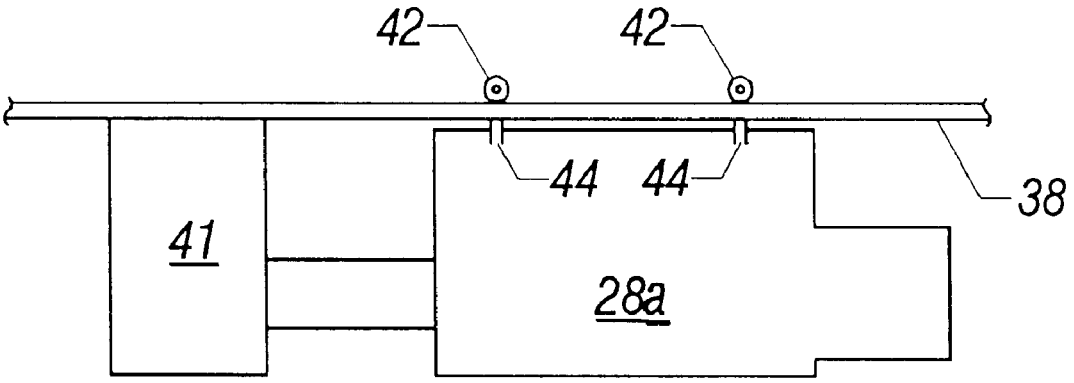
FIG. 6 is a side elevation view of a diverter housing and actuator.
Figure 7:
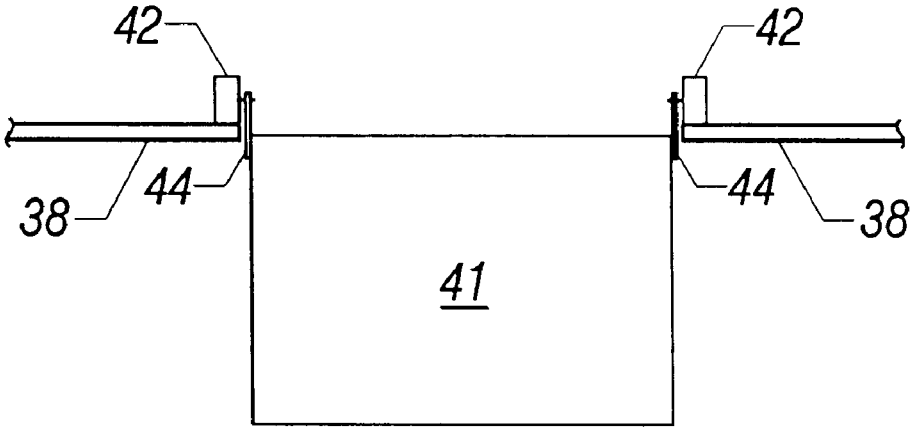
FIG. 7 is a rear elevation view of a diverter housing.

An alternative mechanism for facilitating movement of the diverter housing uses rollers 42 to engage the rails 38, as shown in FIGS. 6 and 7. The rollers are attached to the sides of the diverter housing by tabs which extend above the top of the diverter housing. The rollers 42 rest on the rails 38 and support the diverter housing 28*a*, allowing it to be moved along the rails 38. The rails 38 are extended beneath the rig floor 16 and on either side of the well center. The rails 38 are preferably parallel. By moving the diverter housing 28*a* along the rails 38, the diverter housing 28*a* can be centered beneath the well center 22.

The motive force is applied to the diverter housing by an actuator 41 as previously described.

It can be appreciated by persons skilled in the art that other mechanisms for engaging the diverter housing with the rails are known in the art. It can also be appreciated by persons skilled in the art that mechanisms other than rails can be used to guide the diverter housing into position. Any mechanism that will provide guided movement of the diverter housing from its storage position to the well center will accomplish the purpose of the rails. For example, the guide may be a pivot, such as a pin or a hinge, which allows the diverter housing to be swung away from the well center. The guide may be a mechanized arm which moves the diverter housing away from the well center. It can also be appreciated that the mechanism described can be used with other offshore drilling rigs such as jack-up rigs, tethered platforms, and spars. These alternative mechanisms are intended to be covered by what is claimed.

Figure 8:
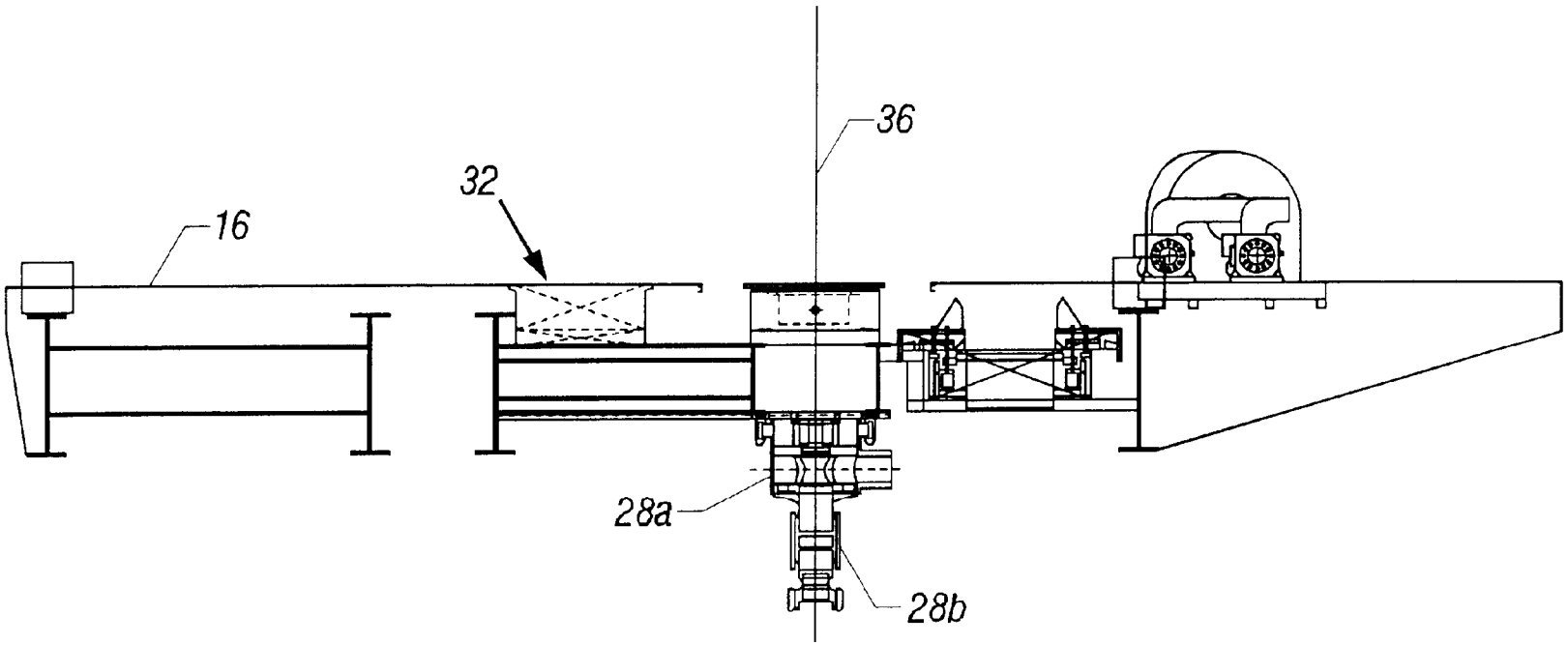
FIG. 8 is a side elevation view of a detail of the rig floor.

Once the diverter housing 28*a* is in position beneath the well center 22, as shown in FIG. 8, it is locked in position with bolts or some other locking mechanism (not shown). The diverter insert assembly 28*b* then may be lifted from its storage position in the rig floor area and attached to the riser. That combination is then lowered through the well center 22 until it seats in and latches to the diverter housing 28*a*, completing installation of the riser.

When the drilling operation is complete, the diverter insert assembly 28*b*, which is still attached to the riser 20, is lifted out of the diverter housing 28*a*. The diverter insert assembly 28*b* is then disconnected from riser 20 and placed in storage in the rig floor. The actuator 41 then moves the diverter housing 28*a* back into its storage position.

What is claimed is:

1. A movable diverter comprising a diverter insert assembly;

a diverter housing configured to house the diverter insert assembly;

the diverter housing engaged with a guide adapted for attachment to an underside of a rig floor; and the diverter housing configured to be moveable in engagement with the guide between a first position below a well center and a second position displaced from the well center.

2. The movable diverter of claim 1, wherein the guide comprises a rail.

3. The movable diverter of claim 1, wherein the guide comprises two parallel rails.

4. The movable diverter of claim 1, wherein the diverter housing engages the guide with rollers.

5. The movable diverter of claim 1, wherein the guide comprises rails; and the diverter housing engages the guide with shoulders adapted to slide along the rails.

6. The movable diverter of claim 1, wherein the guide comprises a pivot.

7. A drilling vessel comprising a rig floor;

a guide attached to an underside of the rig floor; and a diverter housing configured to move in engagement with the guide between a first position and a second position.

8. The movable diverter of claim 7, wherein the guide comprises a rail.

9. The movable diverter of claim 7, wherein the guide comprises two parallel rails.

10. The movable diverter of claim 7, wherein the diverter housing engages the guide with rollers.

11. The movable diverter of claim 7, wherein the guide comprises rails; and the diverter housing engages the guide with shoulders adapted to slide along the rails.

12. The movable diverter of claim 7, wherein the guide comprises a pivot.

13. A movable diverter housing comprising:

a guide adapted to be mounted to the underside of a drill floor on a drilling rig; and a diverter housing adapted to engage and move along the guide.

14. The movable diverter housing of claim 13, wherein the guide comprises a rail.

15. The movable diverter housing of claim 13, wherein the guide comprises two parallel rails.

16. A movable diverter housing comprising:

a guide adapted to be mounted to the underside of a drill floor on a drilling rig; and a diverter housing adapted to move in engagement with the guide, wherein the diverter housing engages to the guide with rollers.

17. A movable diverter housing comprising:

a guide adapted to be mounted to the underside of a drill floor on a drilling rig; and a diverter housing adapted to move in engagement with the guide, wherein the guide comprises rails and the diverter housing engages the guide with shoulders adapted to slide along the rails.

18. A method for engaging a diverter in an offshore vessel comprising storing a diverter housing at a diverter housing storage position while a riser is being run through a well center of the drilling rig;

moving the diverter housing in engagement with a guide from the diverter storage position to near the riser running area by engaging it with an actuator;

coupling the riser to the diverter insert assembly; and inserting a diverter insert assembly into the diverter housing.

19. A drilling vessel comprising:

a rig floor, the rig floor having a well center; and a diverter insert assembly, wherein the drilling vessel is adapted to allow the diverter insert assembly to be stored in a storage position in the rig floor away from the well center.

20. The drilling vessel of claim 19, wherein the storage position is located beneath a aperture in the rig floor.

21. The drilling vessel of claim 20, further comprising a bracket located at the storage position and configured to receive the diverter insert assembly.

* * * * *